US005934953A

United States Patent [19]

Kobayashi

[11] Patent Number: 5,934,953

[45] Date of Patent: Aug. 10, 1999

[54] INSPECTION HOLE FOR JET PROPULSION UNIT

[75] Inventor: Noboru Kobayashi, Iwata, Japan

[73] Assignee: Yamaha Hatsudoki Kabushiki Kaisha, Iwata, Japan

[21] Appl. No.: 08/696,360

[22] Filed: Aug. 13, 1996

[30] Foreign Application Priority Data

Aug. 15, 1995 [JP] Japan ..... 7-208066
Sep. 13, 1995 [JP] Japan ..... 7-235530

[51] Int. Cl.[6] ..... B63B 11/00

[52] U.S. Cl. ..... 440/38; 440/113

[58] Field of Search ..... 114/270; 440/1, 440/2, 38, 88, 89, 113, 77

[56] References Cited

U.S. PATENT DOCUMENTS

| | | | |
|---|---|---|---|
| 3,868,833 | 3/1975 | Noe et al. | 440/38 |
| 5,197,909 | 3/1993 | Rossitto | 440/88 |
| 5,522,742 | 6/1996 | Futaki et al. | 440/46 |
| 5,536,189 | 7/1996 | Mineo | 440/89 |

FOREIGN PATENT DOCUMENTS

| | | | |
|---|---|---|---|
| 58586 | 4/1982 | Japan | 114/270 |
| 406024386 | 2/1994 | Japan | 440/89 |
| 406135377 | 5/1994 | Japan | 114/270 |
| 406191469 | 7/1994 | Japan | 440/38 |

*Primary Examiner*—Ed L. Swinehart
*Attorney, Agent, or Firm*—Knobbe, Martens, Olson & Bear LLP

[57] ABSTRACT

Two embodiments of jet-propelled watercraft having an arrangement wherein both the jet propulsion unit and engine of the watercraft can be accessed through access openings formed in the hull to the rear of the passenger's compartment. In addition, a telltale system is provided for discharging the water from the engine cooling jacket in a locale where the operator can readily view it to assure himself that the engine is receiving adequate coolant.

20 Claims, 9 Drawing Sheets

INSPECTION HOLE FOR JET PROPULSION UNIT

BACKGROUND OF THE INVENTION

This invention relates to a jet-propelled watercraft and more particularly to an inspection system for servicing the jet propulsion unit of such a watercraft and a telltale indicator for such watercraft.

As is well known, jet propulsion units have a number of advantages over more conventional open propeller systems for watercraft. The jet propulsion unit permits operation in much shallower water and reduces the likelihood of damage to the propulsion system when underwater obstacles are encountered. However, the very nature of the jet propulsion unit in permitting shallow water operation gives rise to the problem that foreign objects may become ingested in the propulsion unit. Of course, by providing grates or screens over the water inlets, the ingestion of larger objects can be avoided. However, the ingestion of smaller objects and things such as seaweed still can present problems.

One of the advantages of the jet propulsion unit is that it can be concealed in the under hull of the watercraft and thus provides a neater and unencumbered overall configuration. However with such under-hull mountings, the water inlet opening is downwardly facing and thus a problem arises in conjunction with the removal of foreign objects from the jet propulsion unit.

It is, therefore, a principal object of this invention to provide an improved jet propelled watercraft wherein the propulsion unit is accessible for servicing from above without necessitating removal of the propulsion unit for such servicing.

There have been proposed arrangements wherein inspection openings are formed in the upper portion of the jet propulsion unit. By appropriately configuring the hull, this opening can then be accessed and foreign objects can be removed from above. However, this necessitates the positioning of the access opening in an area of the hull where the hull configuration may be such that other purposes for the use o the hull are desired.

It is, therefore, a still further object of this invention to provide an improved watercraft hull arrangement utilizing a jet propulsion unit wherein a cleanout arrangement for the jet propulsion unit is provided and can be easily accessed without sacrificing the utility of this area of the hull.

It is a further object of this invention to provide an improved cleanout arrangement for the hull of a watercraft having a jet propulsion unit.

One other additional shortcoming with the provision of inboard mounted and concealed jet propulsion units and powering internal combustion engines is that it may be difficult at times to provide a visual indication to the operator that cooling water is flowing through the engine. Outboard type of propulsion units such as the outboard portion of an inboard/outboard drive or an outboard motor, per se, generally employ "telltales" which provide a visual indication to the operator that water is being passed through the cooling jacket of the engine when it runs. These telltales spray a small amount of the cooling water out of the upper portion of the outboard drive. One disadvantage with these systems is that the water spray or telltale is frequently located in a location where the operator cannot see it. This is particularly true where there is a forwardly positioned operator's area.

Therefore, it is another principal object of this invention to provide an improved telltale unit for a watercraft having a jet propulsion unit wherein the telltale is located so that it can be easily viewed by the operator.

It is a further object of this invention to provide such a telltale unit for a dual propulsion system for a jet propelled watercraft.

SUMMARY OF THE INVENTION

A first feature of this invention is adapted to be embodied in a jet-propelled watercraft that is comprised of a hull that defines a rider's area and an enclosed engine compartment. A jet propulsion unit is mounted at least in part within the hull and behind the engine compartment and this jet propulsion unit is driven by the engine. The jet propulsion unit is comprised of an outer housing assembly that defines a water inlet portion through which water is drawn from the body of water in which the watercraft is operating, an impeller portion for journaling an impeller that pumps the water and a discharge nozzle portion through which the pumped water is discharged for generating a propulsion force to the watercraft. This outer housing assembly includes an access opening that is formed in an upper surface thereof through which at least a portion of the interior of the jet propulsion unit may be accessed for service without removal of the jet propulsion unit from the hull. The hull has a portion which extends generally over the engine and the jet propulsion unit and which has an opening area therein through which the engine and jet propulsion unit access opening can be reached for servicing. A selectively openable cover covers the opening area.

Another feature of the invention is adapted to be embodied in a jet-propelled watercraft that is comprised of a hull that defines a rider's area having an operator's location therein and an enclosed engine compartment. A pair of jet propulsion units are mounted at least in part within the hull behind the engine compartment and each is driven by a respective water-cooled internal combustion engine positioned in the engine compartment. Means are provided for circulating water through each of the engine cooling jackets for cooling the respective engines. Each engine is provided with a telltale water outlet that is connected by means of a conduit to juxtaposed discharge areas in the outer surface of the hull and in an area where they can be seen by an operator in the operator's location.

DETAILED DESCRIPTION OF THE PREFERRED EMBODIMENTS OF THE INVENTION

Figure 1:
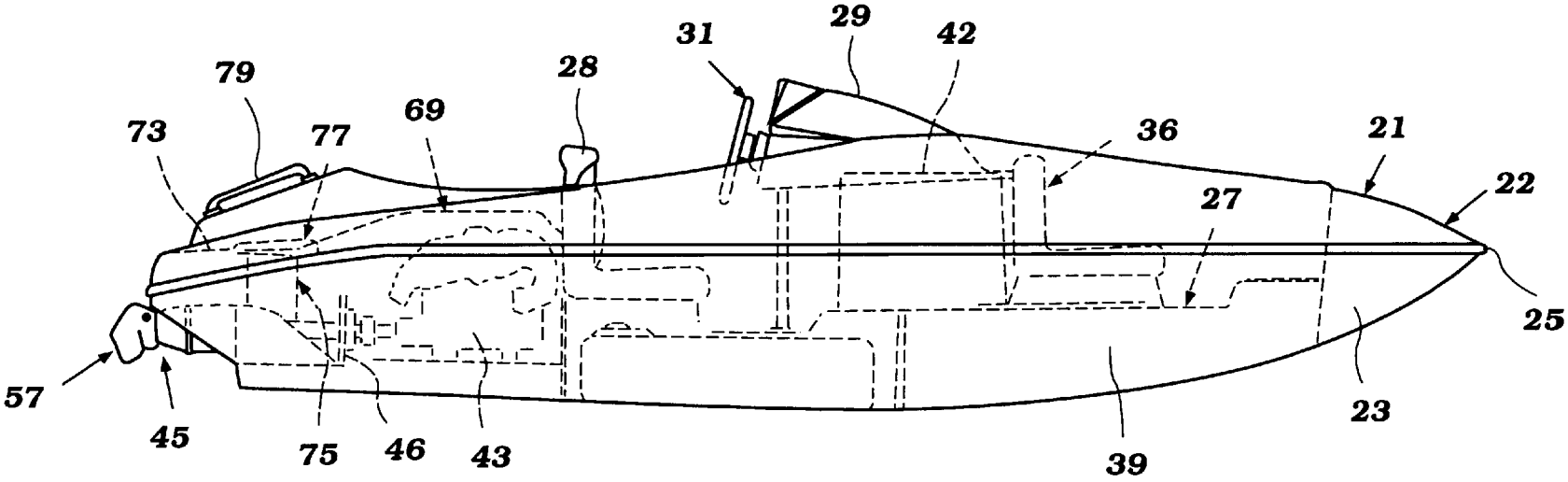
FIG. 1 is a side elevational view of a jet-propelled watercraft constructed in accordance with a first embodiment of the invention.
Figure 2:
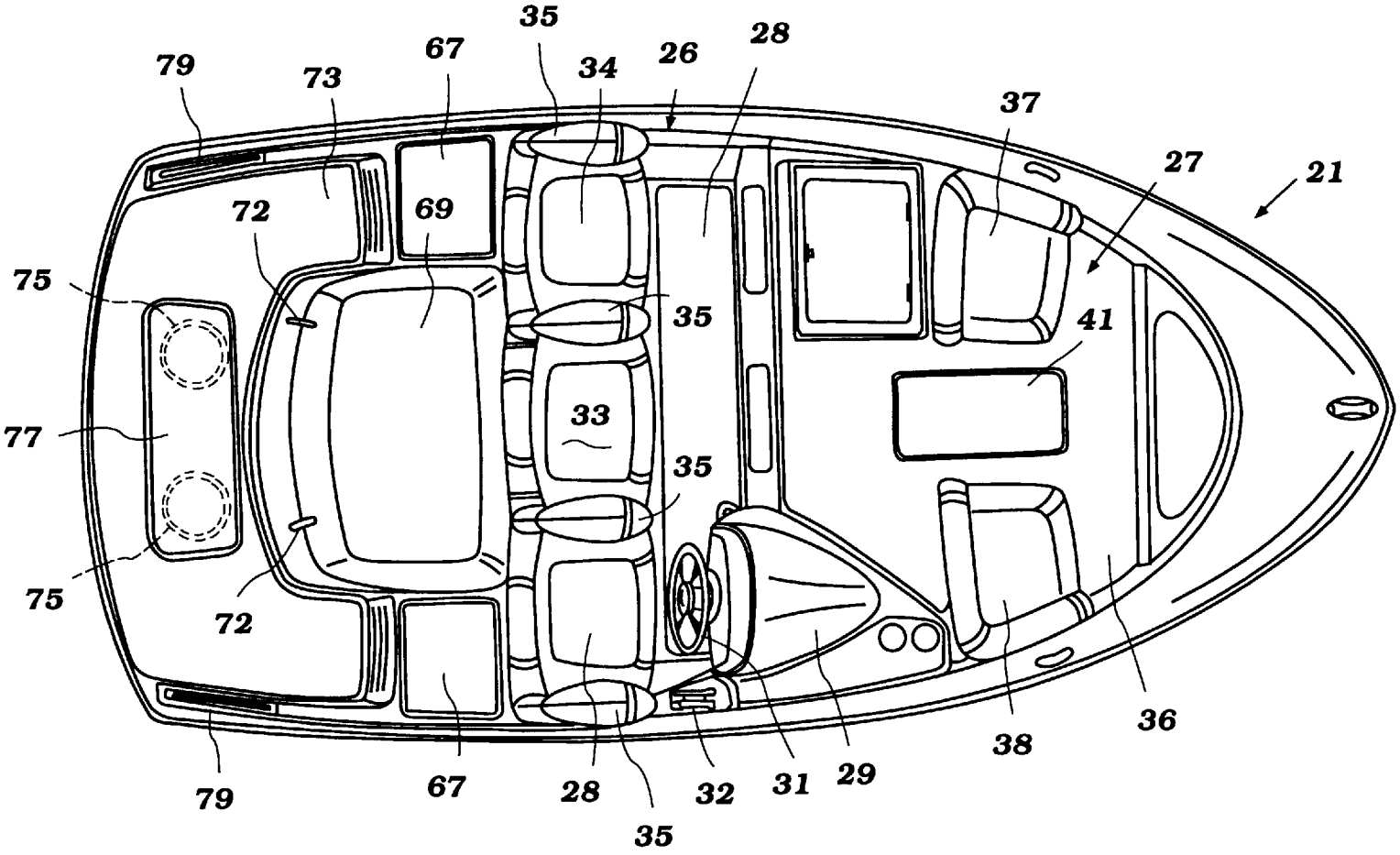
FIG. 2 is a top plan view of the watercraft.

Referring now in detail to the drawings and initially to the embodiment of FIGS. 1–9 and initially primarily to FIG. 1 and 2, a watercraft constructed in accordance with this embodiment is indicated generally by the reference numeral 21. As will become apparent from this and following descriptions, the overall layout of the watercraft 21 in the various embodiments disclosed is only typical of many types of watercraft layouts that may be employed in conjunction with the invention. The invention deals primarily with the propulsion system for the watercraft, the means of accessing of it for servicing, and the telltale that indicates that cooling water is passing through the cooling jackets of the engine. Thus, these portions of the watercraft 21 of this and other embodiments will be described in more detail than the basic watercraft configuration. Although the invention has particular utility in conjunction with the watercraft configurations that will be described, it will be apparent to those skilled in the art how the invention can be practice with a wide variety of types of watercraft using those inventive features mentioned.

The watercraft 21 is comprised of a hull assembly, indicated generally by the reference numeral 22, that is comprised of an under-hull portion 23 and an upper-hull deck portion 24. These hull portions 23 and 24 are formed from a suitable material such as a molded, fiberglass reinforced resin or the like. These hull portions are fixed to each other in a suitable manner, for example, around a funnel 25, that extends around the outer periphery of the watercraft 21 and which forms in part a splash shield therefor.

In the embodiments of the watercraft which are illustrated, the watercraft are depicted of the so-called bow-rider types wherein there is provided a main passenger compartment or passenger area, indicated generally by the reference numeral 26, and a forward or bow-rider passenger area, indicated generally by the reference numeral 27. Referring first to the main passenger's area 26, it is comprised of a floor 28 that extends transversely across the watercraft and which is open upwardly. A seat assembly extends transversely across the passenger compartment 26 and includes a rider/operator seat 28 that is positioned behind a control panel 29. This control panel 29 mounts a steering wheel 31 for steering of the watercraft 21 in a manner which will be described and an engine speed and propulsion control, indicated generally by the reference numeral 32. As will become apparent as the description proceeds, the watercraft 21 is provided with a pair of propulsion units and the control 32 includes a pair of levers, one for each of these units.

A pair of passenger seats 33 and 34 are provided in side-by-side relationship next to the operator seat 28 and behind the floor area 28. For side support, bolsters 35 may be provided between each of the seats 28, 33, and 34.

The bow-rider's area 27 includes a floor 36 and a pair of transversely spaced apart passenger seats 37 and 38. A pass-through may be provided between the main passenger's area 26 and the bow rider's area 27. The area under the floor 36 provides an enlarged storage compartment 39 that may be accessed through an openable hatch 41 and which can be utilized to store a wide variety of paraphernalia. A further storage compartment and accessible hatch 42 is provided behind one of the seats, specifically, the seat 37.

As should be apparent from FIGS. 1 and 2, the main passenger's area 26 is disposed substantially forwardly of the watercraft transom which transom is indicated by the reference numeral 40. This provides a very substantial area for the propulsion unit for the watercraft 21. In accordance with the embodiments of the invention and particularly this embodiment, the propulsion system includes a pair of side-by-side parallel propulsion units, each of which comprises a powering internal combustion engine, indicated generally by the reference numeral 43, which is provided in an engine compartment area 44 and a jet propulsion unit, indicated generally at 45, which is disposed to the rear of a bulkhead 46 that forms the rear end of the engine compartment 44. The jet propulsion unit 45 is concealed in substantial part beneath the hull portion 23 and a major portion of the jet propulsion unit 45 is contained within the undersurface of the hull portion 23.

Figure 6:
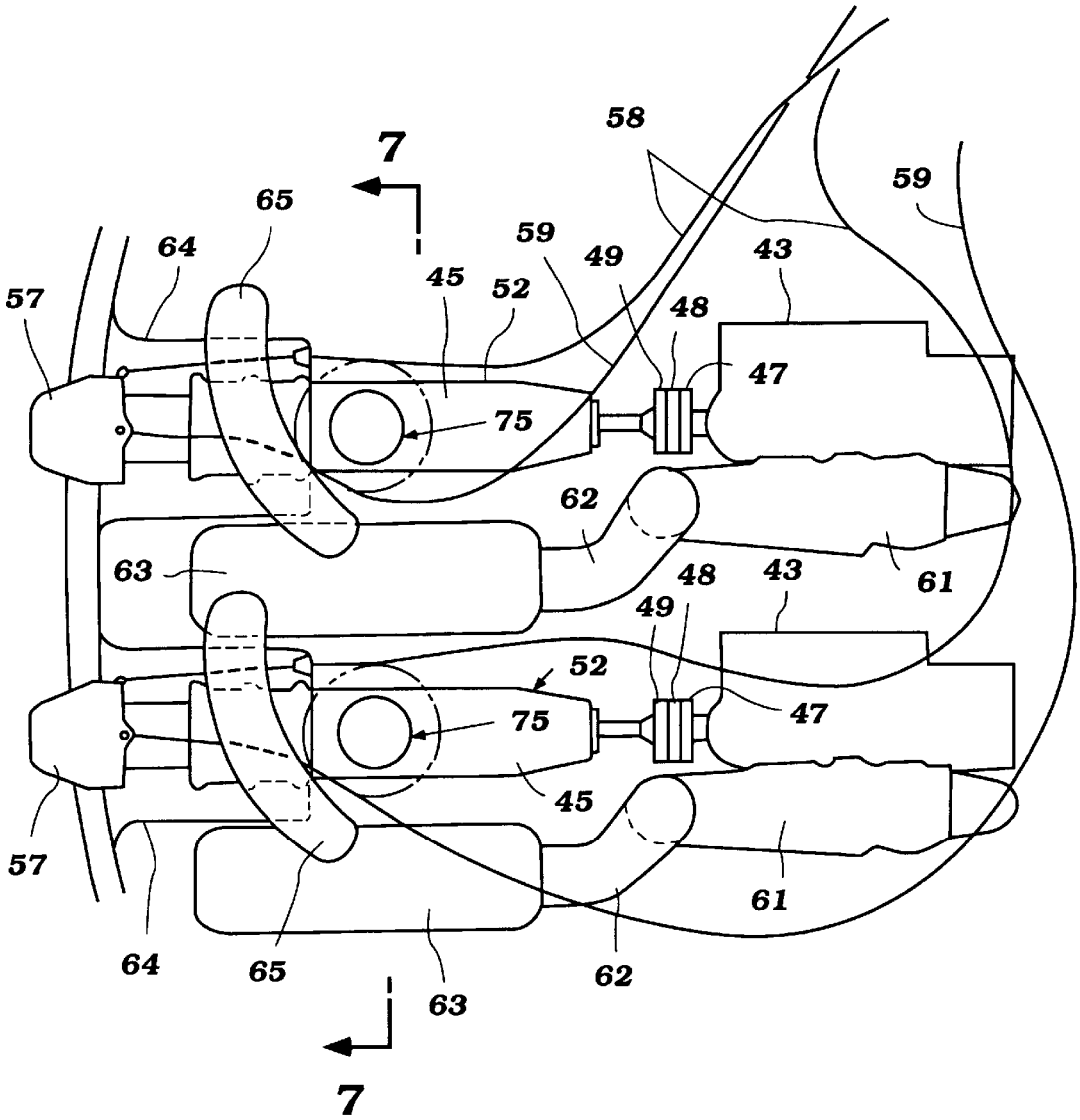
FIG. 6 is a top plan view showing the propulsion units and their relationship to the exhaust systems for the engines.
Figure 7:
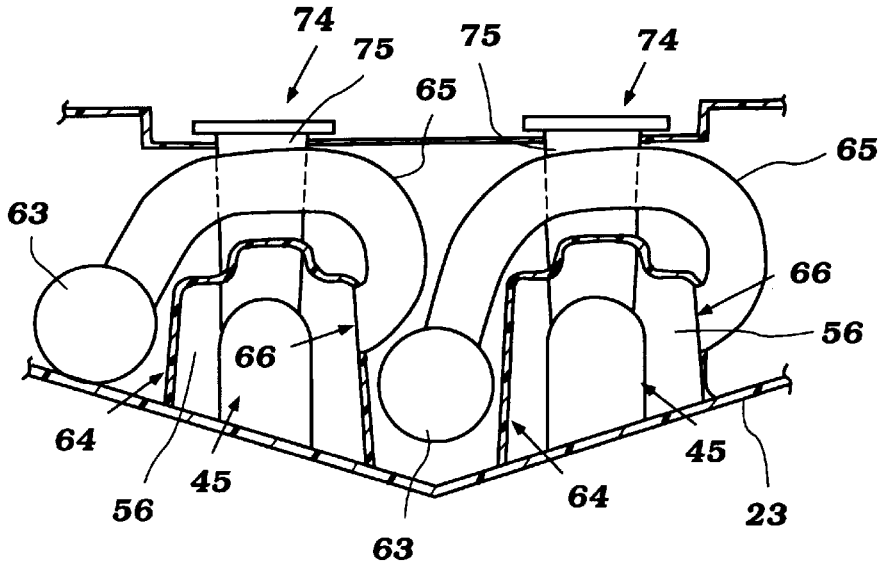
FIG. 7 is a cross-sectional view taken generally along the line 7—7 of FIG. 6.
Figure 8:
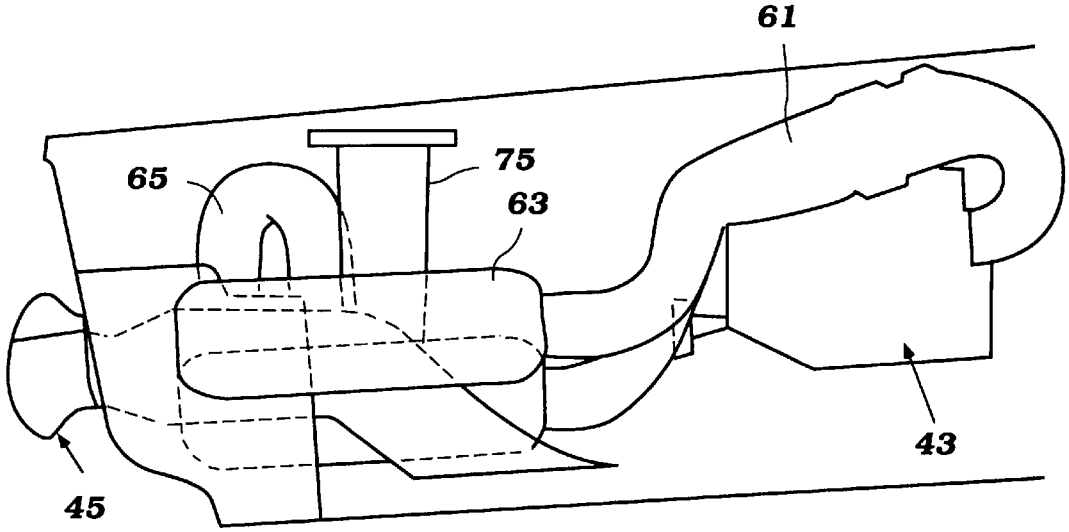
FIG. 8 is a side elevational view in part similar to FIG. 3 but shows in more detail the relationship of the engine exhaust system to the cleanout system for one of the jet propulsion units.

Referring first to the engines 43 and as best seen in FIGS. 6–8, the engines 43 are in the illustrated embodiment of the inline type and incorporate a number of cylinders, preferably two or three. In the illustrated embodiment, the engines 43 operate on a two stroke, crankcase compression principle. It will be readily apparent, however, to those skilled in the art that the invention may be employed in conjunction with engines having various configurations and operating on different principles. Each engine 43 is mounted so that its crankshaft 47 extends along a longitudinal axis. These crankshafts 47 are coupled by flexible couplings 48 to a flange 49 fixed on the forward end of an impeller shaft 51 of the respective jet propulsion unit 45.

Each jet propulsion unit 45 is comprised of an outer housing assembly, indicated generally by the reference numeral 52, which forms a downwardly facing water inlet portion 53 that draws water from the body of water in which the watercraft is operating. This water is pumped by an impeller that is contained within an impeller portion 54 of the outer housing 52 and which is disposed to the rear of the water inlet portion 53. The impeller (not shown) of each jet propulsion unit 35 is coupled to the impeller shaft 51 and is driven in a well known manner. Finally, the outer housing 52 of each jet propulsion unit 45 includes a rearwardly facing discharge nozzle portion 55 that discharges the water rearwardly for providing a propulsion force for the watercraft.

As seen in FIG. 7, a portion of each jet propulsion unit 45 is mounted in a tunnel 56 that is formed by the hull undersurface.

A combined steering and reverse thrust bucket assembly, indicated generally by the reference numeral 57 is mounted in receiving alignment with the discharge nozzles 55 so that the water discharged therefrom can be steered about a vertically-extending steering axis, as controlled by a bowden wire steering mechanism 58. In addition, the reverse thrust bucket portion of the assembly 57 can be brought into a confronting relationship with the discharge nozzle so as to redirect the discharged water forwardly and create a reverse thrust action. Wire actuators 59 are connected for this purpose.

The wire actuators 58 are operated by the steering wheel 31 and the actuators 59 may be controlled by the control levers 32 or additional control levers juxtaposed thereto. Since the construction of the jet propulsion units 45, per se, and the operation of the steering and reverse thrust bucket assemblies 57 is of the type known in this art, a further description of it is not believed to be necessary to permit those skilled in the art to practice the invention.

One facet of the engines 43 is significant in connection with the invention and this deals with the exhaust treatment for each engine 43. This system will now be described again by primary reference to FIGS. 6–8.

Each engine 43 is provided with a combined exhaust manifold, expansion chamber device, indicated generally by the reference numeral 61 and which is mounted on one side of the respective engine. As should be apparent from the figures, each propulsion unit has the same configuration and hence, in this embodiment, the expansion chamber exhaust manifold assemblies 61 are disposed on the right-hand side of the engines 43.

These exhaust manifold and expansion chamber devices 61 may be provided with cooling jackets, as is well known in this art, through which coolant from the respective engine 43 is circulated. Each engine is water-cooled and coolant is delivered to the engine cooling jackets for their cooling in a suitable manner and a manner which will be described by particular reference to the embodiments of FIGS. 9–12. This water can then be discharged into the exhaust manifold cooling jacket and eventually returned to the body of water in which the watercraft is operating along with the exhaust gases.

Exhaust pipes 62 convey the exhaust gases from each of the exhaust manifold and expansion chamber devices 61 to a respective water trap device 63 which is disposed on the right-hand side of the respective tunnel 56 and specifically on the right-hand side of an outer shell thereof, indicated by the reference numeral 64, and which is formed as a part of the hull undersurface 23. These water trap devices 63 are internally baffled and have sufficient volume so as to contain any water which may enter the exhaust system through the discharge and prevent that water from flowing to the engine combustion chambers through the exhaust pipe 62 and manifold 61.

This reverse water flow is precluded by providing a trap section 65 which extends from each water trap device 63 to a high elevation across the top of the tunnel-forming shell 64 as shown best in FIGS. 7 and 8 and which trap device 65 then discharges the exhaust gases into the tunnel 56 through a discharge opening 66. Thus, ingestion of water to the engine through the exhaust system is precluded.

Figure 3:
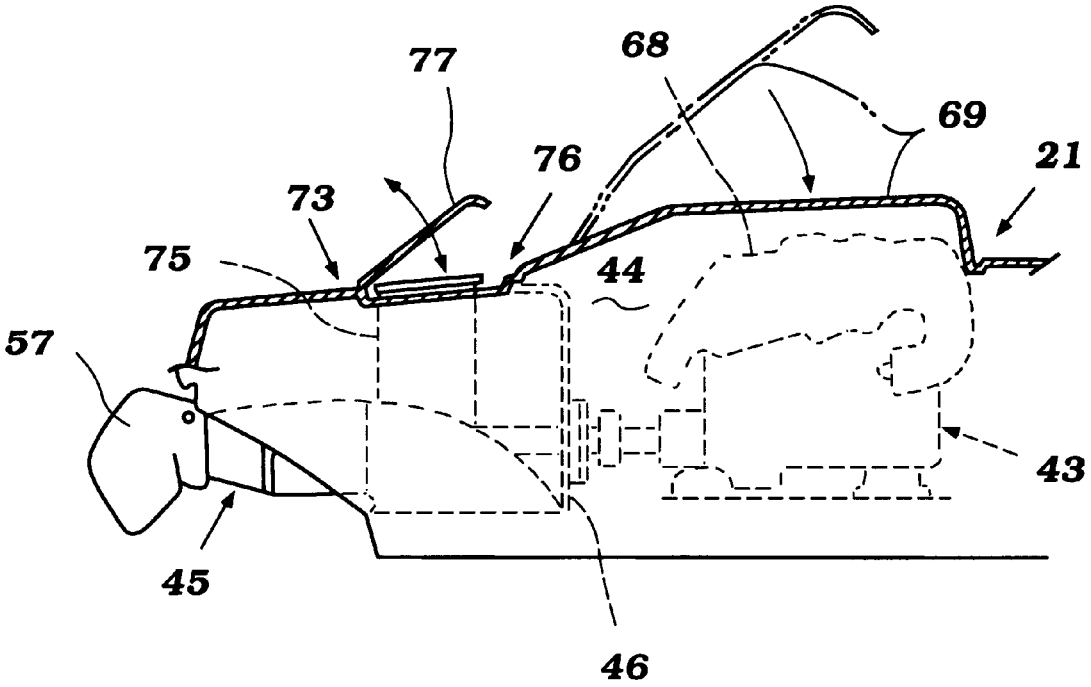
FIG. 3 is a partial view of the rear portion of the watercraft showing the service access hatches both opened and closed and the related serviced components shown in phantom.
Figure 4:
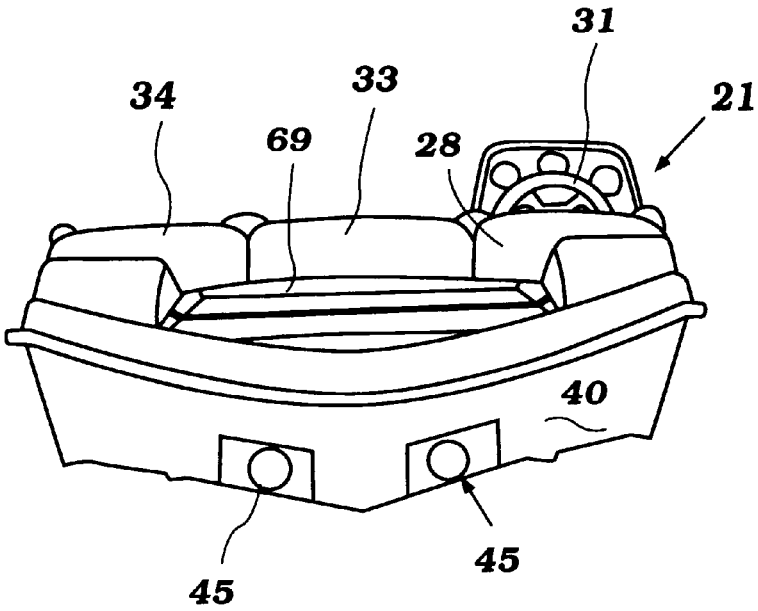
FIG. 4 is a rear elevational view of the watercraft of this embodiment.
Figure 5:
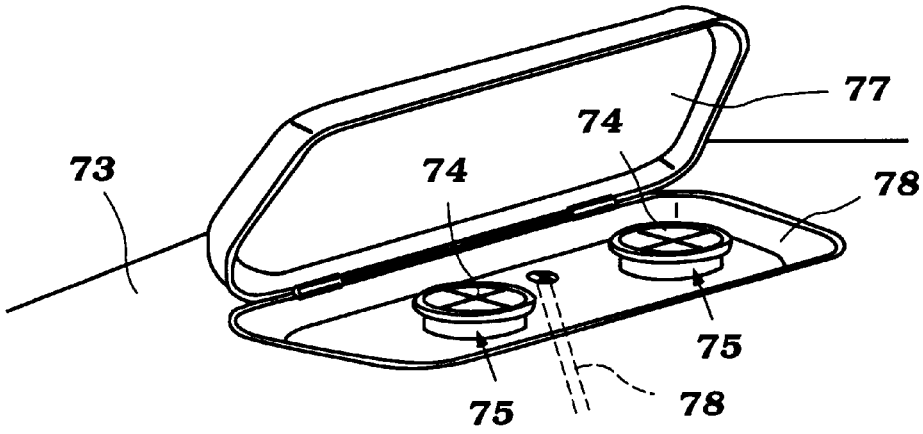
FIG. 5 is a front perspective view showing the jet propulsion units hatch cover in its opened, service position and illustrates the relationship of the enclosed area around the two cleanout arrangements.

As best seen in FIGS. 2 and 3, the area behind the seats and specifically behind the centermost seat 33 is provided with a rear deck portion 67 having an opening 68 which extends across the upper portion of the engine compartment 44. A pivotally-supported hatch cover 69 is pivotal about a pivot axis formed by hinges 72 at the rear end of this hatch cover 69 so that the hatch cover 69 may be opened as shown in phantom lines in FIG. 3 so as to permit servicing of the engines 43 without their removal.

A farther rear deck, indicated generally by the reference numeral 73 extends to the rear of the deck portion 67 and is at a somewhat lower vertical height than it. This deck portion 73 extends across the upper portion of the jet propulsion units 45. As has been noted from the foregoing discussion, because the jet propulsion units 45 permit operation in very shallow water, they also may be prone to picking up foreign matter. Therefore, each jet propulsion unit 45, and specifically its outer housing, is provided with a cleanout device, indicated generally by the reference numeral 74.

These cleanout devices include extensions 75 of the outer housing in an area adjacent the water inlet opening portion 53. Closures (not shown) are provided for these cleanout devices 75 and may have a configuration as described in U.S. Pat. No. 5,522,742, entitled "Clean-Out Arrangement For Jet Propelled Watercraft", issued Jun. 4, 1996 and assigned to the assignee hereof, the disclosure of which is incorporated herein by reference.

These cleanout devices 75 extend up into a well 76 that is formed in the rear deck portion 73 and which is closed by a pivotally supported hatch 77. The hatch 77 is pivotal about a rear hinge axis by suitable hinges. As may be seen in FIG. 5, when this hatch cover 77 is opened, the cleanout portions 74 may be readily accessed and the closure plugs removed so that foreign material can be drawn out of the water inlet opening and from around the impeller shaft and impeller.

A drain hose 78 is provided in the well 76 and drains back to the body of water in which the watercraft is operating so that any water which is spilled during this cleanup operation will not stain the outer body of the watercraft. Thus, this construction provides a very effective way in which cleanout of the jet propulsion units can be accomplished without necessitating removal of the watercraft 21 from the body of water in which it is operating nor requiring removal of the jet propulsion units 45. It should be noted that the well 76 permits this area to serve as a storage compartment.

The rear deck area 73 is bounded by a pair of raised portions on which grab handles 79 are provided.

In this embodiment, there is a separate hatch cover 69 for the engine access opening 68 and a separate cover 77 for the well 76. A single cover could be employed for closing both openings, if desired.

Figure 9:
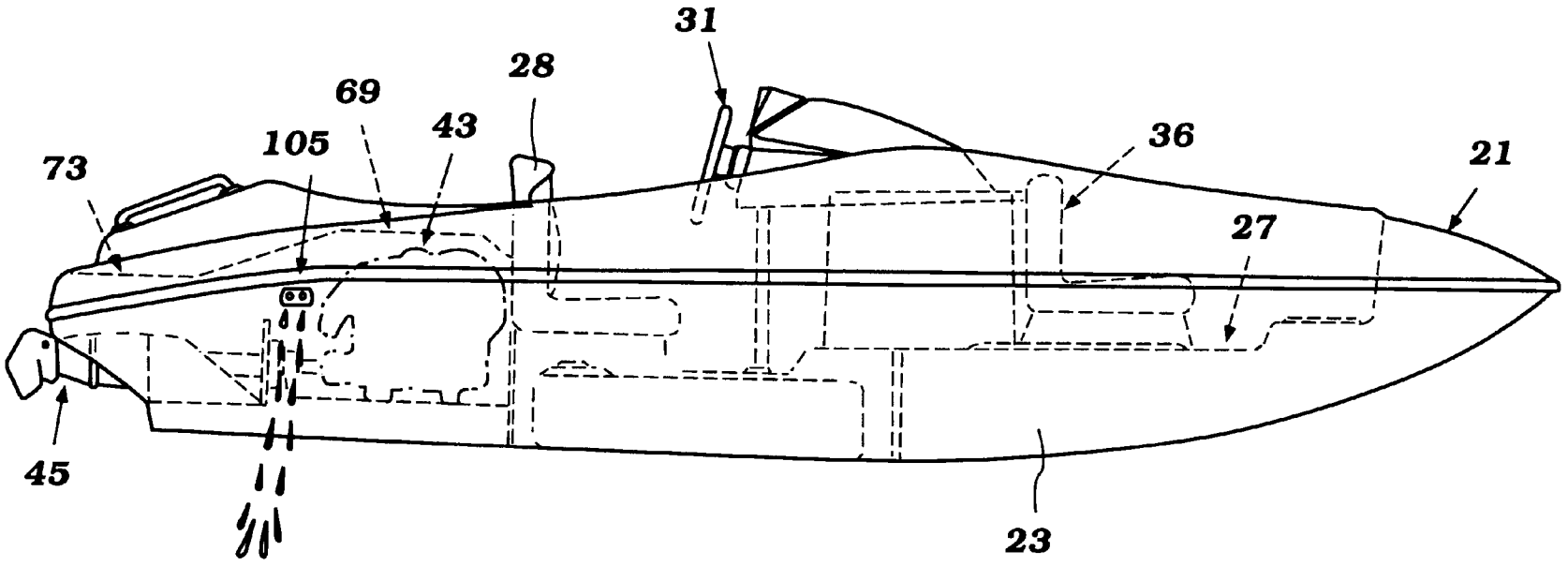
FIG. 9 is a side elevational view, in part similar to FIG. 1, and shows another embodiment of the invention.
Figure 10:
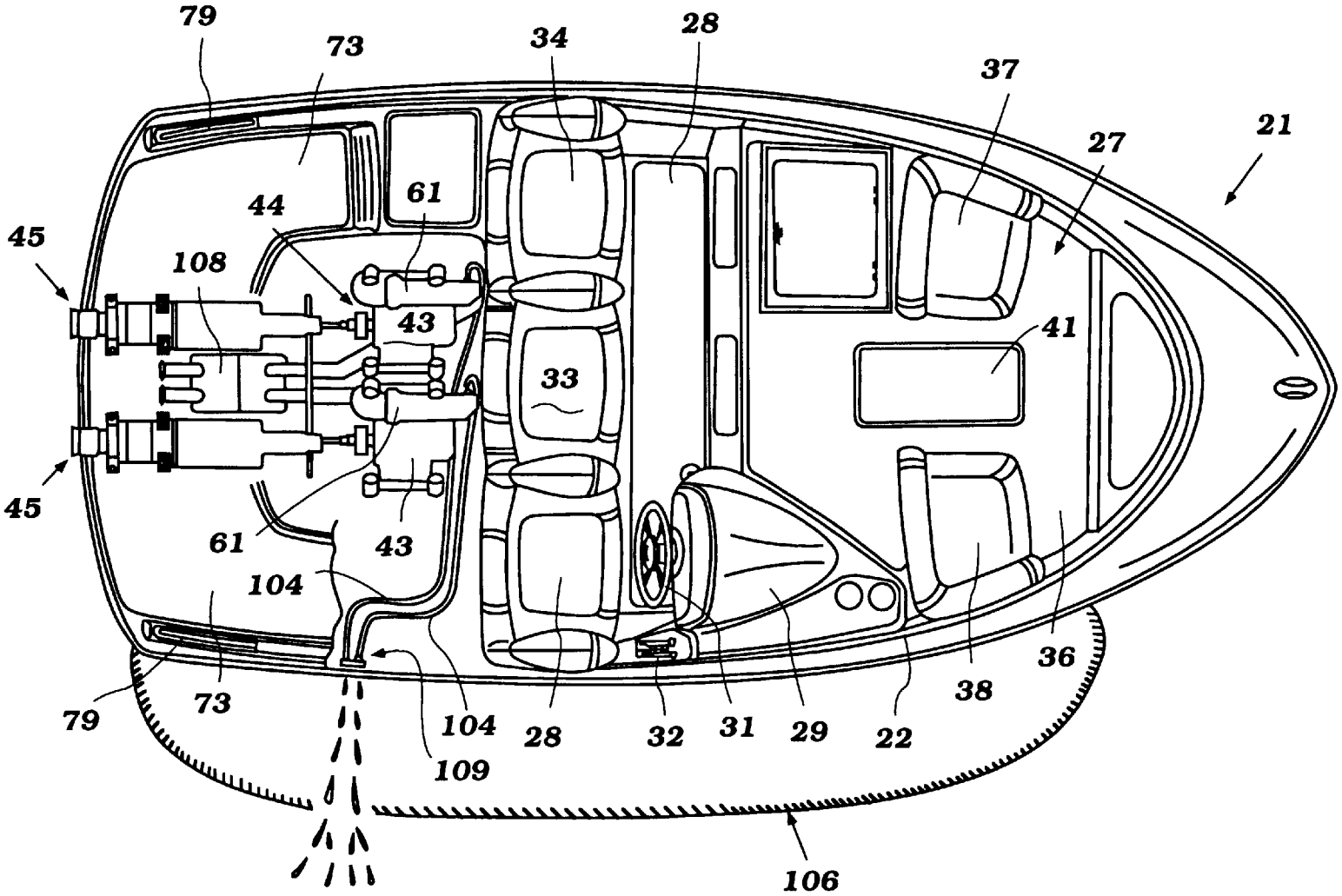
FIG. 10 is a top plan view of this embodiment.
Figure 11:
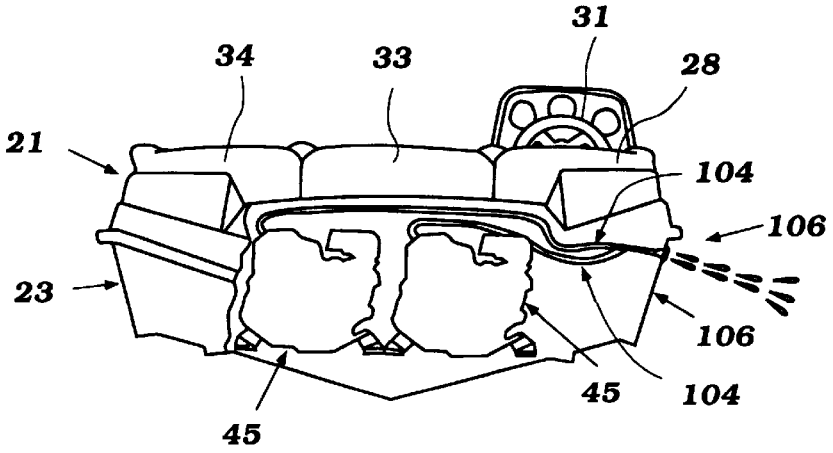
FIG. 11 is a rear elevational view, wit a portion broken, away, of this embodiment, and shows the telltale arrangement, of this second embodiment.
Figure 12:
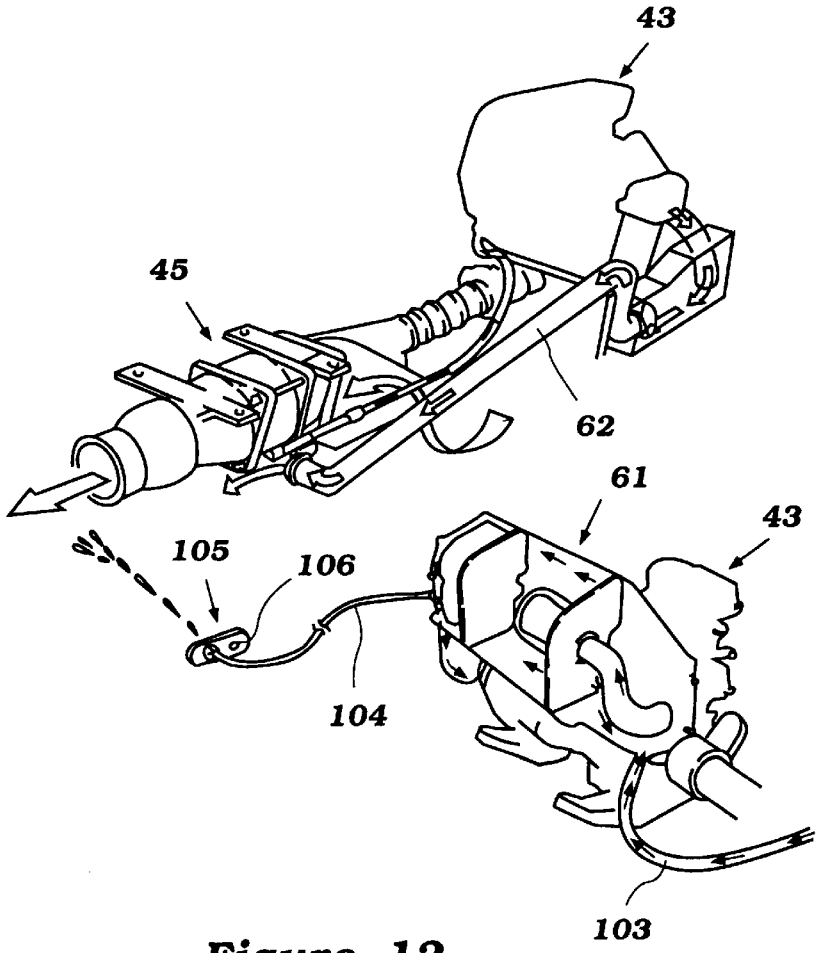
FIG. 12 is a partially schematic View showing, in th upper portion, a view looking at the engine from one side and, in the lower portion, a view looking at the engine from the other side and showing the relationship of the telltale and the flow of cooling water and exhaust gases through the engine.

FIGS. 9–11 show another embodiment of the invention which is generally similar to the embodiment thus far described. Since the basic construction of the accessing for the engines 43 for their servicing and the jet pumps 45 for their cleanout is the same as that already described, these components have not been illustrated again in any significant detail nor will they be described. In addition, where components in this embodiment are the same as that previously described or substantially the same, they have been identified by the same reference numerals and will be described again, only insofar as is necessary to understand the construction and operation of this embodiment.

This embodiment deals primarily with the cooling system for the engines 43 and the telltale system that permits the operator seated in the operator's seat 28 to be assured that each engine is receiving coolant. This cooling system is shown best in FIG. 12. As will be seen, each engine 43, only one of which is shown in this figure, has a cooling jacket to which cooling water is delivered through a supply conduit 101. The supply conduit 101 receives water under pressure from an inlet fitting 102 that communicates with the impeller section 54 of the jet propulsion unit outer housing. Hence, the impeller also acts as a water pump to supply water to the respective engine cooling jacket through the conduit 101.

This coolant is then circulated from the engine cooling jacket to the aforenoted cooling jacket that surrounds the exhaust manifold and expansion chamber device 61. This coolant is passed in this jacket as shown schematically by the conduit 103 in FIG. 12 and circulates through the cooling jacket. This cooling jacket has a first discharge conduit 104 through which a portion but not all of this circulated coolant is discharged.

This conduit 104 extends to a telltale device 105 that is mounted in the side of the hull portion 23 in the area indicated by the shaded area 106 in FIG. 10. This is an area that is below the gunnel 25 but at a high enough location so that an operator seated in this seat 28 can assure himself that coolant is flowing through the cooling jackets of each of the engines 43. Thus, the telltale device 105 has a pair of discharge outlets 106 in side-by-side relationship each of which will emit a small spray of coolant as indicated in the figures. If the operator notices that either one or both of the sprays from the openings 106 is interrupted, he will be warned that that engine may not be receiving adequate coolant and protective action can be taken.

This embodiment also shows an arrangement wherein the exhaust pipes 62 both pass next to each other and serve a common water trap device 108 that is disposed between the jet propulsion units 45 and which discharges to the body of water in any appropriate manner. A watertrap of the type previously described may also be utilized. The jet unit clean out as well as its access and the access and hatches for these areas are not illustrated, but they may be of the forms already described.

Thus, from the foregoing description, it should be readily apparent that the described embodiments of the invention provide a very effective arrangement for permitting servicing of both the engine and cleaning of the jet propulsion units while still in the body of water in which the watercraft is operating. In addition, a simple and accessible telltale arrangement permits the operator to ascertain that coolant is passing through both engines.

Those skilled in the art will readily understand that the foregoing description is that of preferred embodiments of the invention and that various changes and modifications may be made without departing from the spirit and scope of the invention, as defined by the appended claims.

What is claimed is:

1. A jet-propelled watercraft comprised of a hull defining a rider's area and an engine compartment, a jet propulsion unit mounted at least in part in said hull behind said engine compartment and driven by said engine, said jet propulsion unit being comprised of an outer housing defining a water inlet portion through which water is drawn from the body of water in which said watercraft is operating, an impeller portion containing an impeller driven by said engine for pumping water and a discharge nozzle portion through which water pumped by said impeller is discharged for providing a propulsion force for said watercraft, an access opening formed in an upper surface of said jet propulsion unit outer housing through which at least a portion of the interior of said jet propulsion unit may be accessed for servicing without removal of said jet propulsion unit from said hull, said hull having a portion extending over said engine and said jet propulsion unit and having an access opening therein through which said engine and said jet propulsion unit access opening can be reached for servicing, and a selectively openable cover for said hull opening area.

2. A jet-propelled watercraft as set forth in claim 1, wherein the hull access opening comprises a pair of spaced apart access openings, one of which affords access to the engine and the other of which affords access to the jet propulsion unit access opening.

3. A jet-propelled watercraft as set forth in claim 2, wherein each of the access openings of the hull is provided with a separate selectively openable cover.

4. A jet-propelled watercraft as set forth in claim 3, wherein one of the access openings of the hull and the related cover is disposed at a lower vertical level than the other.

5. A jet-propelled watercraft as set forth in claim 4, wherein the access opening and cover for the jet propulsion unit access opening is vertically lower than that for the engine.

6. A jet-propelled watercraft as set forth in claim 1, wherein the hull access opening is formed to the rear of but accessible from the passenger's area.

7. A jet-propelled watercraft as set forth in claim 6, wherein the access opening comprises a pair of spaced apart access openings, one of which affords access to the engine and the other of which affords access to the jet propulsion unit access opening.

8. A jet-propelled watercraft as set forth in claim 7, wherein each of the access openings of the hull is provided with a separate selectively openable cover.

9. A jet-propelled watercraft as set forth in claim 8, wherein one of the access openings of the hull and the related cover is disposed at a lower vertical level than the other.

10. A jet-propelled watercraft as set forth in claim 9, wherein the access opening and cover for the jet propulsion unit access opening is vertically lower than that for the engine.

11. A jet-propelled watercraft as set forth in claim 10, wherein the access opening and cover for the jet propulsion unit access opening is substantially flush with a rear deck of the watercraft.

12. A jet-propelled watercraft as set forth in claim 11, wherein the access opening for the jet propulsion unit access opening extends into a depressed storage area formed by the hull.

13. A jet-propelled watercraft as set forth in claim 12, further including a water drain in said depressed storage area for draining water directly back to the body of water in which the watercraft is operating.

14. A jet-propelled watercraft as set forth in claim 1, wherein the jet propulsion unit is contained at least in part in a tunnel formed in the undersurface of the hull.

15. A jet-propelled watercraft as set forth in claim 14, wherein the engine has an exhaust system which discharges the exhaust gases from the engine at least in part into the tunnel.

16. A jet-propelled watercraft as set forth in claim 15, wherein the exhaust system has a portion that extends across the upper surface of the tunnel and which forms a trap section to preclude water from flowing to the engine through the exhaust system.

17. A jet-propelled watercraft as set forth in claim 16, wherein the portion of the exhaust system which extends across the tunnel extends to the rear of the jet propulsion unit access opening.

18. A jet-propelled watercraft as set forth in claim 1, wherein the engine is water cooled, and further including water circulating means for circulating water from the body of water in which the watercraft is operating through the engine cooling jacket, and a telltale for discharging at least a portion of the engine cooling water through the side of the hull contiguous to an operator's position in the rider's compartment.

19. A jet-propelled watercraft as set forth in claim 1, wherein there are a pair of engines and jet propulsion units disposed in side-by-side relationship and each of which is provided with a respective access opening.

20. A jet-propelled watercraft as set forth in claim 19, wherein the engines are water cooled, and further including water circulating means for circulating water from the body of water in which the watercraft is operating through the engine cooling jackets, and a pair of telltales in juxtaposed relation for discharging at least a portion of the engine cooling water through the side of the hull contiguous to an operator's position in the rider's compartment.

* * * * *